US009915917B2

(12) United States Patent
Sakata et al.

(10) Patent No.: US 9,915,917 B2
(45) Date of Patent: Mar. 13, 2018

(54) PROCESS CARTRIDGE CAPABLE OF RESTRAINING FRICTIONAL WEARING OF ELECTRODE PROVIDED AT DEVELOPING UNIT

(71) Applicant: Brother Kogyo Kabushiki Kaisha, Nagoya-shi, Aichi-ken (JP)

(72) Inventors: Isamu Sakata, Obu (JP); Shota Shinoya, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/468,231

(22) Filed: Mar. 24, 2017

(65) Prior Publication Data

US 2017/0285570 A1 Oct. 5, 2017

(30) Foreign Application Priority Data

Mar. 30, 2016 (JP) ..... 2016-067261

(51) Int. Cl.
*G03G 21/18* (2006.01)
*G03G 21/16* (2006.01)

(52) U.S. Cl.
CPC ..... *G03G 21/1867* (2013.01); *G03G 21/1652* (2013.01); *G03G 21/18* (2013.01); *G03G 21/1825* (2013.01); *G03G 21/1871* (2013.01); *G03G 2221/166* (2013.01); *G03G 2221/1861* (2013.01)

(58) Field of Classification Search
CPC ..... G03G 21/1867; G03G 21/1871; G03G 21/1652; G03G 21/1825; G03G 2221/166; G03G 2221/1861
See application file for complete search history.

(56) References Cited

U.S. PATENT DOCUMENTS

| | | | | |
|---|---|---|---|---|
| 7,162,174 | B2 * | 1/2007 | Suzuki | G03G 21/1814 399/111 |
| 7,761,025 | B2 | 7/2010 | Sato | |
| 8,213,825 | B2 | 7/2012 | Sato | |
| 8,983,335 | B2 | 3/2015 | Yamashita et al. | |
| 2005/0191080 | A1 * | 9/2005 | Oguma | G03G 21/1828 399/90 |
| 2007/0160388 | A1 * | 7/2007 | Yoshimura | G03G 21/1825 399/111 |

(Continued)

FOREIGN PATENT DOCUMENTS

| | | |
|---|---|---|
| JP | 2007-193125 A | 8/2007 |
| JP | 2010-092077 A | 4/2010 |

(Continued)

*Primary Examiner* — Ryan Walsh
(74) *Attorney, Agent, or Firm* — Banner & Witcoff, Ltd.

(57) ABSTRACT

A process cartridge has a drum unit having a photosensitive drum; a developing unit having a developing roller and movable relative to the drum unit; a first electrically conductive member provided at the drum unit and configured to contact a terminal of an image forming apparatus; a second electrically conductive member provided at the developing unit; and a third electrically conductive member electrically connected to the first electrically conductive member and to the second electrically conductive member, the third electrically conductive member being deformable in accordance with the movement of the developing unit.

14 Claims, 12 Drawing Sheets

(56) References Cited

U.S. PATENT DOCUMENTS

| | | | | |
|---|---|---|---|---|
| 2007/0166070 | A1 | 7/2007 | Sato | |
| 2008/0159773 | A1* | 7/2008 | Murayama | G03G 21/1867 399/90 |
| 2008/0199204 | A1* | 8/2008 | Ishii | G03G 15/55 399/90 |
| 2009/0003875 | A1 | 1/2009 | Toba et al. | |
| 2009/0003876 | A1 | 1/2009 | Maeshima et al. | |
| 2010/0189460 | A1* | 7/2010 | Lee | G03G 21/1867 399/90 |
| 2011/0002709 | A1 | 1/2011 | Sato | |
| 2011/0299874 | A1* | 12/2011 | Fujiwara | G03G 15/80 399/90 |
| 2013/0251402 | A1 | 9/2013 | Yamashita et al. | |
| 2014/0376943 | A1* | 12/2014 | Nishimura | G03G 15/80 399/90 |
| 2015/0177679 | A1* | 6/2015 | Souda | G03G 21/1619 399/107 |
| 2016/0291536 | A1* | 10/2016 | Shinoya | G03G 21/1803 |

FOREIGN PATENT DOCUMENTS

| | | | |
|---|---|---|---|
| JP | 2010-092078 | A | 4/2010 |
| JP | 2010-217261 | A | 9/2010 |
| JP | 2013-195805 | A | 9/2013 |

* cited by examiner

PROCESS CARTRIDGE CAPABLE OF RESTRAINING FRICTIONAL WEARING OF ELECTRODE PROVIDED AT DEVELOPING UNIT

CROSS REFERENCE TO RELATED APPLICATION

This application claims priority from Japanese Patent Application No. 2016-067261 filed Mar. 30, 2016. The entire content of the priority application is incorporated herein by reference.

TECHNICAL FIELD

The present disclosure relates to a process cartridge including a drum unit and a developing unit. The drum unit and the developing unit are provided with a photosensitive drum and a developing roller, respectively.

BACKGROUND

Japanese Patent Application Publication No. 2013-195805 discloses a process cartridge in which a developing unit is movable relative to the drum unit. In such a conventional process cartridge, micromotion of the developing roller in accordance with surface irregularities of the photosensitive drum can be realized during developing operation, since the developing unit is movable relative to the drum unit. Further, during monochromatic printing, a developing roller for the color of black cam bring into contact with a corresponding photosensitive drum, while remaining developing rollers for other colors can be spaced away from corresponding photosensitive drums.

Further, according to such conventional technique, the developing unit includes a developing electrode for applying developing bias to the developing roller. An electrode provided at a housing of a printer is biased by a spring to contact the developing electrode. Thus, electric power can be supplied from the printer housing to the developing rollers through respective electrodes.

SUMMARY

The present inventors have discovered that in such conventional process cartridge, a problem arises such that the developing electrode may be frictionally worn, since the developing electrode is moved relative to the electrode of the printer housing when the developing roller is moved relative to the photosensitive drum.

It is therefore an object of the disclosure to provide a process cartridge capable of restraining frictional wearing of the electrode or electrically conductive member provided at the developing unit.

This and other objects will be attained by providing a process cartridge having: a drum unit having a photosensitive drum; a developing unit having a developing roller and movable relative to the drum unit; a first electrically conductive member provided at the drum unit and configured to contact a terminal of an image forming apparatus; a second electrically conductive member provided at the developing unit; and a third electrically conductive member electrically connected to the first electrically conductive member and to the second electrically conductive member, the third electrically conductive member being deformable in accordance with the movement of the developing unit.

BRIEF DESCRIPTION OF THE DRAWINGS

The particular features and advantages of the disclosure will become apparent from the following description taken in connection with the accompanying drawings, in which:

FIG. 1(*b*) is a cross-sectional view of the process cartridge according to one embodiment and illustrating a second position of the developing unit;

FIG. 4(*b*) is exploded perspective view of each electrically conductive member for supplying electric power to a supply roller of the developing unit in the process cartridge according to the embodiment;

FIG. 4(*c*) is exploded perspective view of each electrically conductive member for supplying electric power to a layer thickness regulation blade of the developing unit in the process cartridge according to the embodiment;

DETAILED DESCRIPTION

Figure 1A:
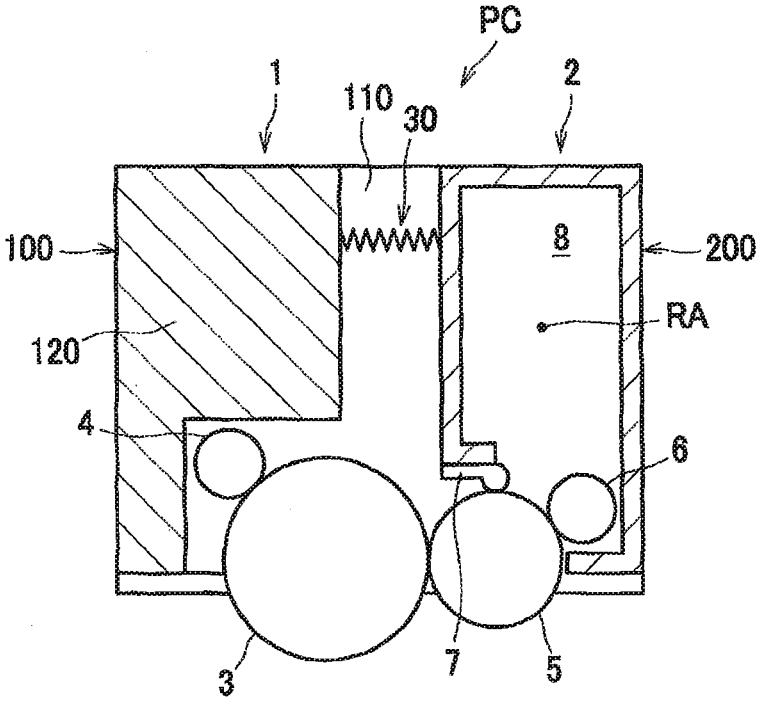
FIG. 1(*a*) is a cross-sectional view of a process cartridge according to one embodiment and illustrating a first position of a developing unit.
Figure 1B:
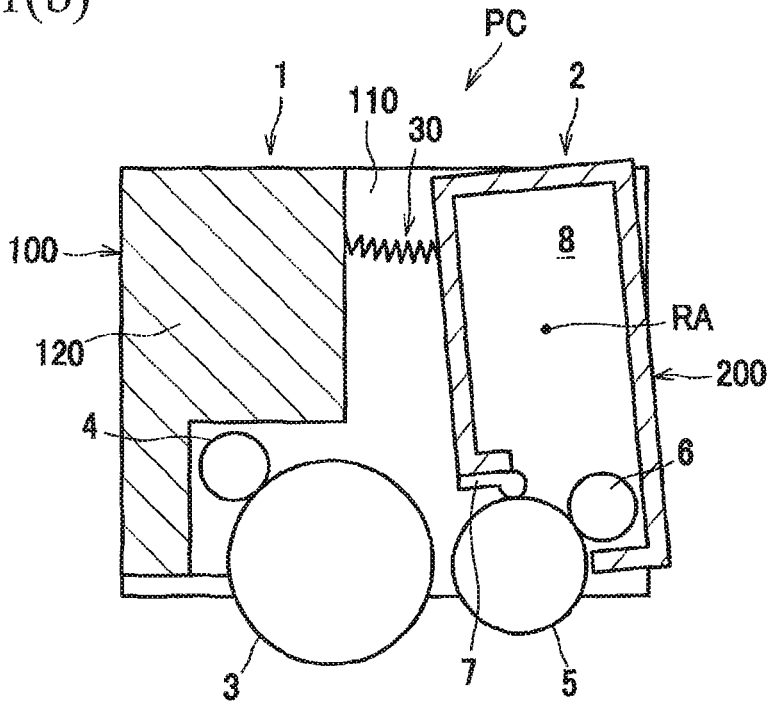

A process cartridge PC according to one embodiment will be described with reference to FIG. 1(*a*) through FIG. 7. As illustrated in FIG. 1(*a*), the process cartridge PC includes a drum unit 1, a developing unit 2, and a third electrically conductive member 30. The drum unit 1 includes a photosensitive drum 3, and the developing unit 2 includes a developing roller 5. The developing unit 2 is pivotally movable about a pivot axis RA relative to the drum unit 1.

In the following description, an extending direction of the pivot axis RA will be referred to as "pivot axis direction", a confronting direction between the developing roller 5 and photosensitive drum 3 and extending perpendicular to the pivot axis direction will be referred to as "first perpendicular direction", and a direction perpendicular to the pivot axis direction and the first perpendicular direction will be referred to as "second perpendicular direction".

The drum unit 1 includes the photosensitive drum 3, a charge roller 4, and a drum frame 100 made from non-conductive resin. The photosensitive drum 3 is adapted to carry toner image. The charge roller 4 is adapted to charge a surface of the photosensitive drum 3.

The drum frame 100 includes a pair of side frames 110 (FIG. 2) and a connection frame 120 connected to each of the side frames 110. Each side frame 110 is positioned at an end portion in an axial direction of the photosensitive drum 3. Each side frame 110 rotatably supports the photosensitive drum 3 and the charge roller 4, and pivotally movably supports the developing unit 2.

The developing unit 2 includes the developing roller 5, a supply roller 6, a layer thickness regulation blade 7, and a developing frame 200 made from non-conductive resin. The developing roller 5 is adapted to carry toner on its surface and to supply the toner to an electrostatic latent image formed on a surface of the photosensitive drum 3.

The supply roller 6 is adapted to supply toner to the developing roller 5 and is positioned beside the developing roller 5. The layer thickness regulation blade 7 is adapted to regulate a thickness of a toner layer formed on the developing roller 5. The layer thickness regulation blade 7 has a tip end portion in contact with the surface of the developing roller 5.

The developing frame 200 is positioned between the side frames 110 and 110, and is pivotally movably supported to the side frames 110. The developing frame 200 has a toner accommodation portion 8 in its internal space for accommodating toner. The developing frame 200 supports the layer thickness regulation blade 7 and rotatably supports the developing roller 5 and the supply roller 6.

The developing unit 2 is pivotally movable between a first position illustrated in FIG. 1(*a*) and a second position illustrated in FIG. 1(*b*). In the first position, the developing roller 5 is in contact with the photosensitive drum 3, and in the second position the developing roller 5 is positioned away from the photosensitive drum 3.

Incidentally, according to a non-contacting type developing system, the developing roller 5 can be slightly separated from the photosensitive drum 3 in the first position. In the latter case, the developing roller 5 is positioned farther away from the photosensitive drum 3 in the second position than in the first position.

The third electrically conductive member 30 is a compression coil spring resiliently deformable, and is interposed between the drum unit 1 and the developing unit 2. The third electrically conductive member 30 is made from electrically conductive material such as metal and electrically conductive resin. The third electrically conductive member 30 is resiliently deformable in accordance with the pivotal movement of the developing unit 2.

The third electrically conductive member 30 urges the developing frame 200 at its portion opposite to the developing roller 5 with respect to the pivot axis RA in the second perpendicular direction. Accordingly, the third electrically conductive member 30 urges the developing roller 5 of the developing unit 2 toward the photosensitive drum 3. The third electrically conductive member 30 is an example of a first urging member.

Figure 2:
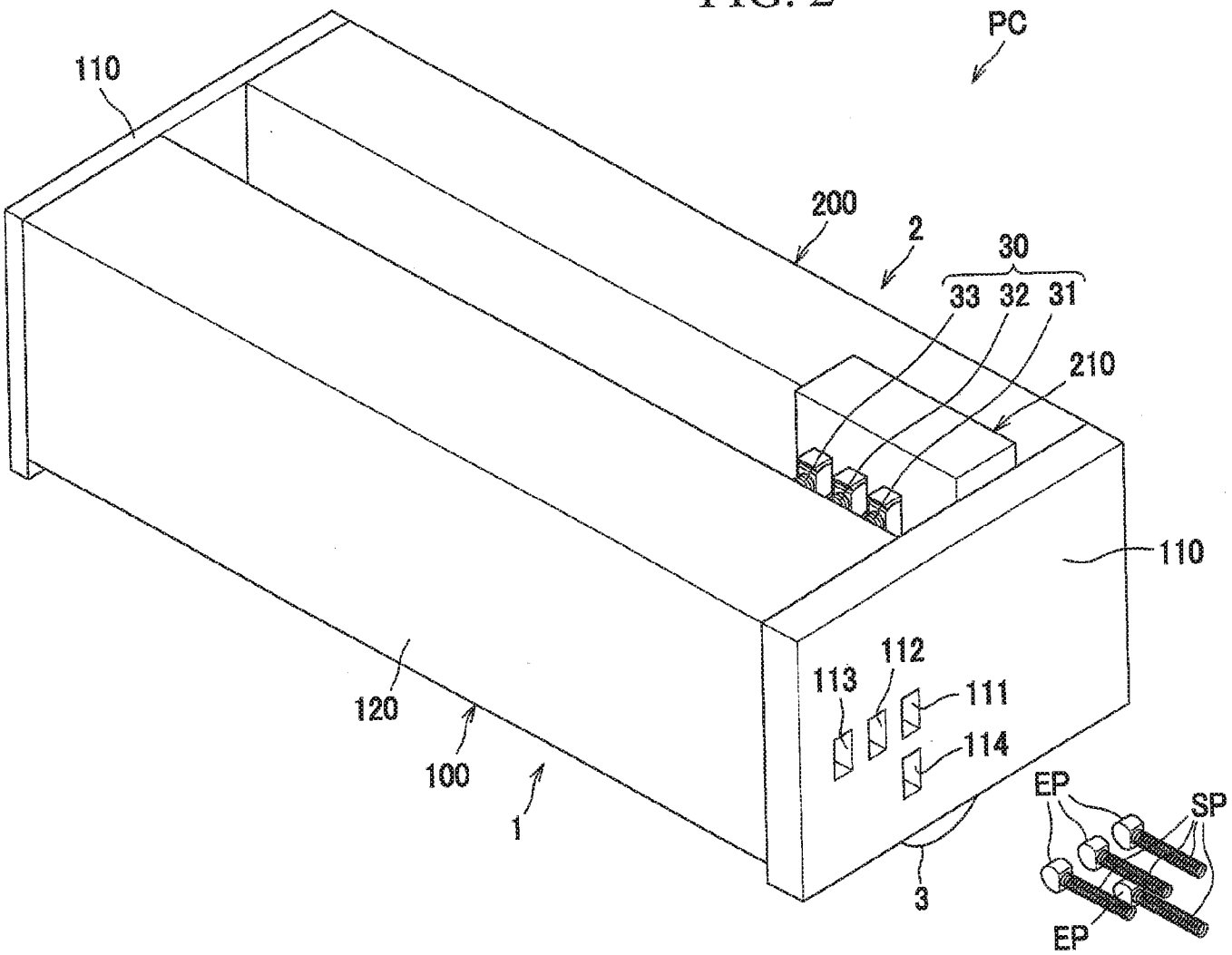
FIG. 2 is a perspective view of the process cartridge according to the embodiment.

As illustrated in FIG. 2, the third electrically conductive member 30 includes a developing roller-use third electrically conductive member 31 for supplying electric power to the developing roller 5, a supply roller-use third electrically conductive member 32 for supplying electric power to the supply roller 6, and a blade-use third electrically conductive member 33 for supplying electric power to the layer thickness regulation blade 7. These members 31, 32, 33 are located at one end portion of the drum frame 100 in the pivot axis direction of the process cartridge PC.

The side frame 110 positioned at one end of the process cartridge PC in the pivot axis direction is formed with a first through-hole 111, a second through-hole 112, a third through-hole 113, and a fourth through-hole 114. These through-holes are adapted to allow four electrodes EP (four contacts) to be inserted therethrough, and each hole has a rectangular shape having a long side extending in the second perpendicular direction and a short side extending in the first perpendicular direction. The four electrodes EP are provided at a housing of an image forming apparatus.

Here, each electrode EP is urged toward the process cartridge PC in the pivot axis direction by a spring SP. During attachment of the process cartridge PC into the housing of the image forming apparatus, the electrodes EP are entered into the through holes 111, 112, 113, 114 by the urging force of the springs SP to bring into contact with electrically conductive members 11, 12, 13, 14 (described later) and illustrated in FIG. 3, when the through-holes 111, 112, 113, 114 are brought into alignment with the positions of the electrodes EP.

Figure 3:
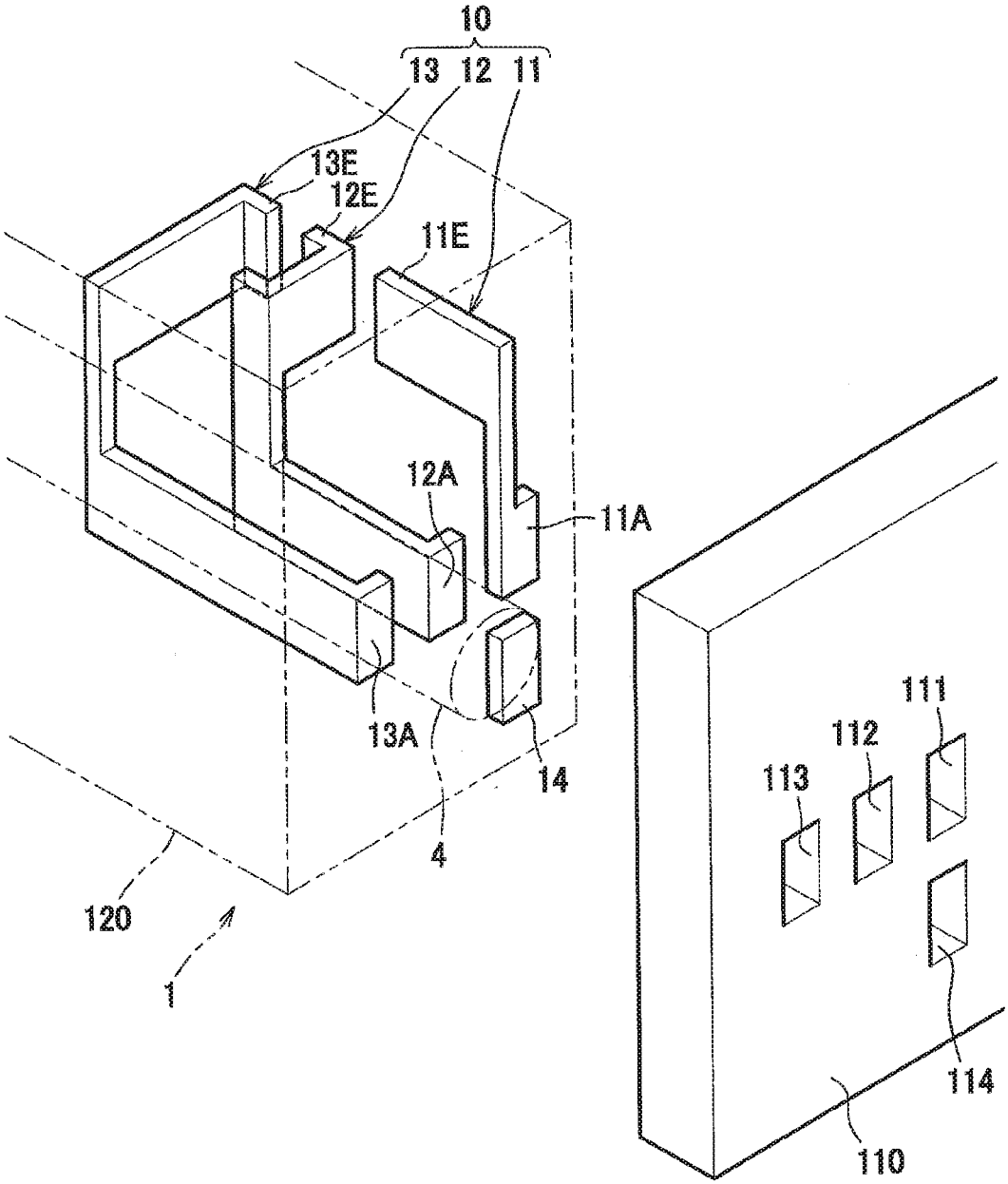
FIG. 3 is an exploded perspective view of each electrically conductive members and a side frame of a drum unit in the process cartridge according to the embodiment.

As illustrated in FIG. 3, the drum unit 1 includes a first electrically conductive member 10 made from electrically conductive resin, and a charge-roller use first electrically conductive member 14 for the charge roller 4. The first electrically conductive member 10 includes a developing roller-use first electrically conductive member 11 for supplying electric power to the developing roller 5, a supply roller-use first electrically conductive member 12 for supplying electric power to the supply roller 6, and a blade-use first electrically conductive member 13 for supplying electric power to the layer thickness regulation blade 7. These electrically conductive members 11, 12, 13, 14 are located at one end portion of the drum unit 1 in the pivot axis direction, and are formed integrally with the connection frame 120 by two color molding (two material two shot molding). Here, the two color molding is integral molding method using two materials different from each other.

The charge roller-use first electrically conductive member 14 is adapted to supply electric power to the charge roller 4. The charge roller-use first electrically conductive member 14 is in contact with the charge roller 4 and is exposed to an outside through the fourth through-hole 114 of the side frame 110.

The developing roller-use first electrically conductive member 11 has an input electrode 11A contactable with the electrode EP provided at the housing of the image forming for receiving electrical power. The input electrode 11A is positioned at one side of the charge-roller use first electrically conductive member 14 in the second perpendicular direction, i.e. at a downstream side of the charge-roller use first electrically conductive member 14 in a direction from the photosensitive drum 3 to the third electrically conductive member 30, and is exposed to the outside through the first through-hole 111. In the following description, regarding the second perpendicular direction, the direction from the photosensitive drum 3 to the third electrically conductive member 30 will be referred to as "the second perpendicular direction," and the opposite direction to the second perpendicular direction will be referred to as "a counter-second perpendicular direction."

The supply roller-use first electrically conductive member 12 has an input electrode 12A contactable with the electrode EP provided at the housing of the image forming for receiving electrical power. The input electrode 12A is positioned at one side of the input electrode 11A in the first perpendicular direction, i.e. at a downstream side of the input electrode 11A in a direction from the developing roller 5 to the photosensitive drum 3, and is exposed to the outside through the second through-hole 112. In the following description, the direction from the developing roller 5 to the photosensitive drum 3 will be referred to as "the first perpendicular direction," and the opposite direction to the first perpendicular direction will be referred to as "a counter-first perpendicular direction."

The blade-use first electrically conductive member 13 has an input electrode 13A contactable with the electrode EP provided at the housing of the image forming for receiving electrical power. The input electrode 13A is positioned at a downstream side of the input electrode 12A in the first perpendicular direction, and is exposed to the outside through the third through-hole 113. The input electrode 11A, input electrode 12A, and input electrode 13A are arrayed in the first perpendicular direction with a space between neighboring electrodes.

Figure 5:
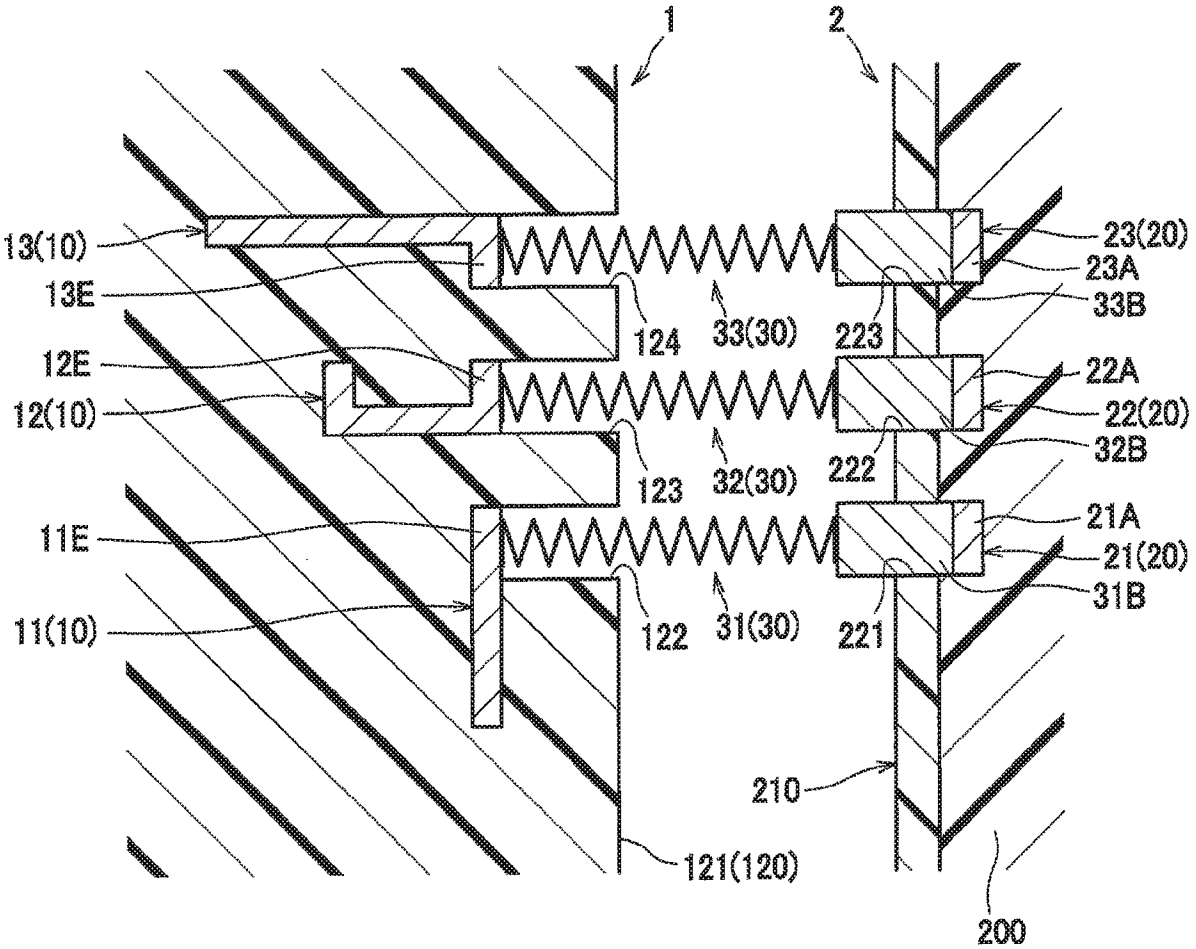
FIG. 5 is a cross-sectional view illustrating a connecting portion between a first electrically conductive member and a third electrically conductive member, and a connecting portion between the third electrically conductive member and a second electrically conductive member in the process cartridge according to the embodiment.
Figure 7:
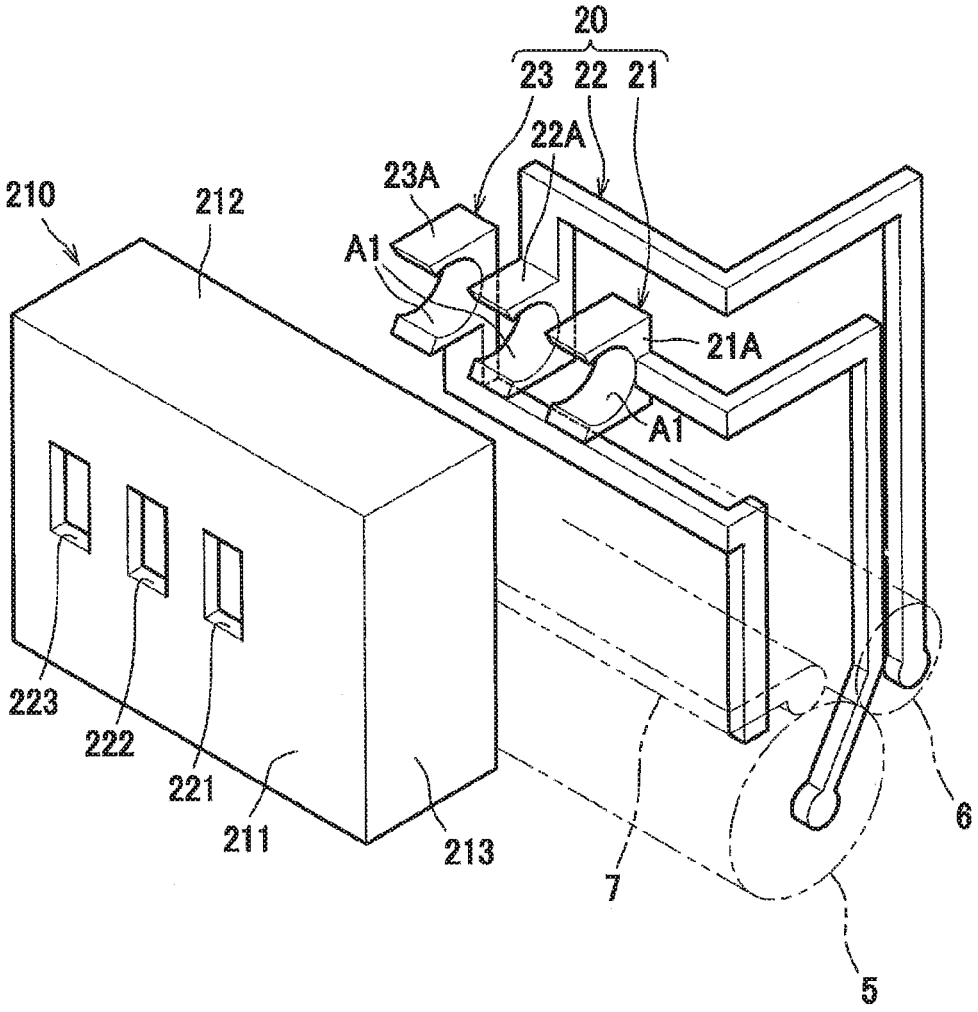
FIG. 7 is a perspective view illustrating a second electrically conductive member and a cover in the process cartridge according to the embodiment.

As illustrated in FIGS. 5 and 7, the developing unit 2 further includes a second electrically conductive member 20 made from electrically conductive resin, and a cover 210 covering the second electrically conductive member 20 and made from non-conductive resin. The second electrically conductive member 20 includes a developing roller-use second electrically conductive member 21 in contact with the developing roller 5, a supply roller-use second electrically conductive member 22 in contact with the supply roller 6, and a blade-use second electrically conductive member 23 in contact with the layer thickness regulation blade 7. These electrically conductive members 21, 22, 23 are positioned at one end portion of the developing unit 2 in the pivot axis direction, and are integral with the developing frame 200 by two color molding.

Figure 4A:
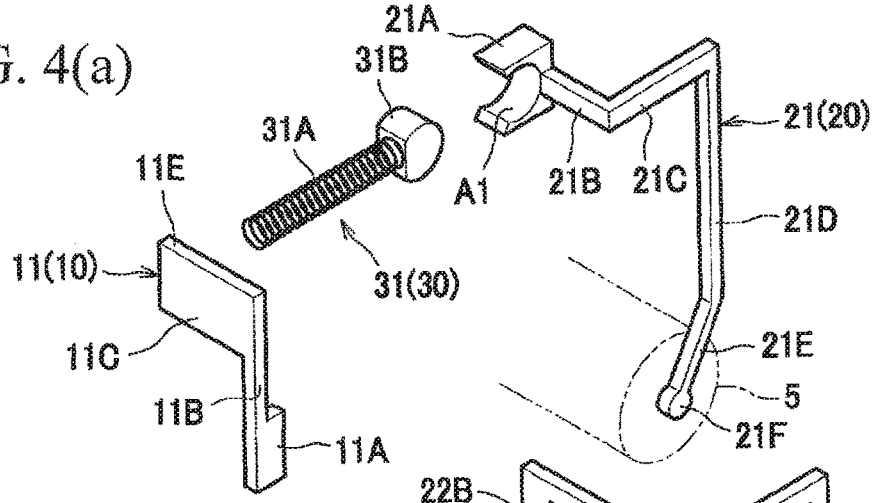
FIG. 4(*a*) is exploded perspective view of each electrically conductive member for supplying electric power to the developing roller of a developing unit in the process cartridge according to the embodiment.
Figure 4B:
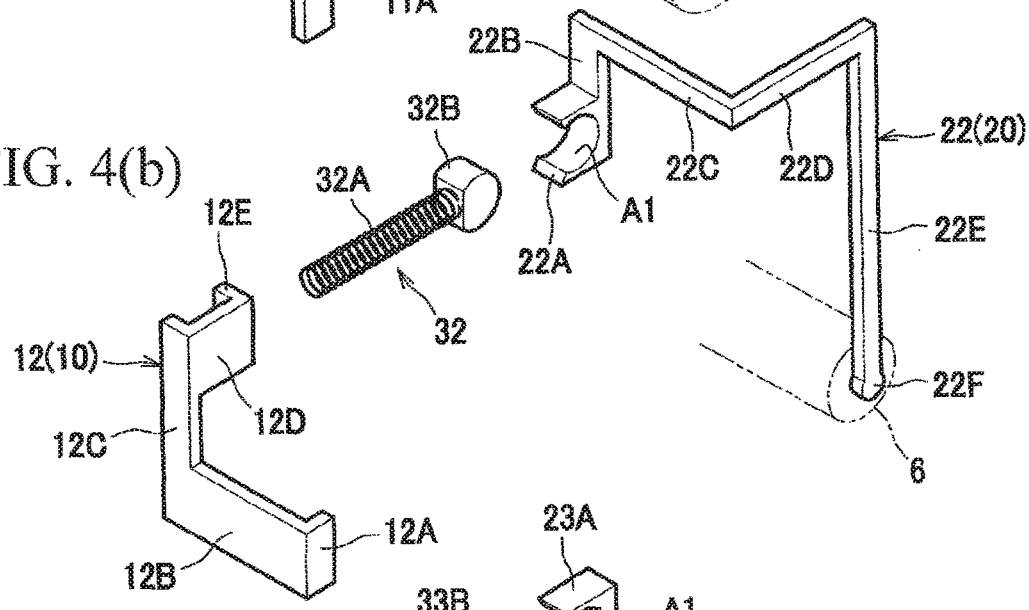
Figure 4C:
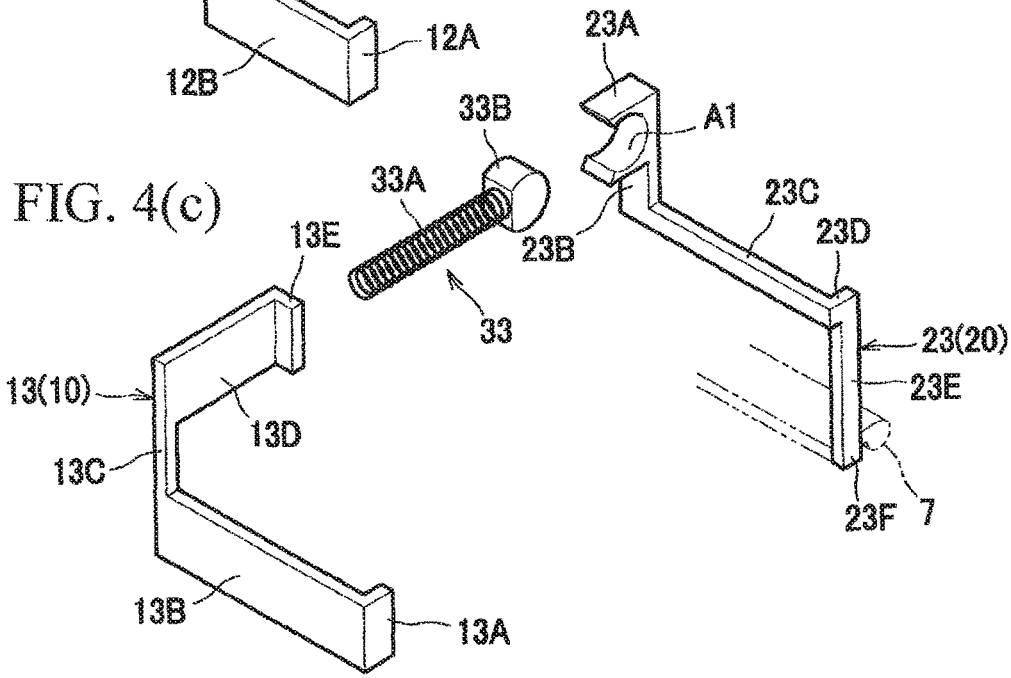

As illustrated in FIG. 4(*a*), the developing roller-use first electrically conductive member 11 is connected to the developing roller 5 through the developing roller-use third electrically conductive member 31 and the developing roller-use second electrically conductive member 21. The developing roller-use first electrically conductive member 11 includes the input electrode 11A, a first extending portion 11B extending in the second perpendicular direction from the input electrode 11A, and a second extending portion 11C extending inward in the pivot axis direction from one end portion in the second perpendicular direction of the first extending portion 11B. The inward end portion of the second extending portion 11C in the pivot axis direction functions as an output electrode 11E in contact with the developing roller-use third electrically conductive member 31 for outputting electrical power to the developing roller-use third electrically conductive member 31.

The developing roller-use third electrically conductive member 31 includes a body portion 31A in a form of compression coil spring, and a contact portion 31B provided at one end of the body portion 31A and made from electrically conductive material. The contact portion 31B is in contact with the developing roller-use second electrically conductive member 21 and has an arcuate cross-sectional shape taken along an imaginary plane perpendicular to the pivot axis direction. The supply roller-use third electrically conductive member 32 and the blade-use third electrically conductive member 33 have structure identical to that of the developing roller-use third electrically conductive member 31. That is, the supply roller-use third electrically conductive member 32 includes a body portion 32A and the contact portion 32B, and the blade-use third electrically conductive member 33 includes a body portion 33A and a contact portion 33B.

As illustrated in FIG. 4(*b*), the supply roller-use first electrically conductive member 12 is connected to the supply roller 6 through the supply roller-use third electrically conductive member 32 and the supply roller-use second electrically conductive member 22. The supply roller-use first electrically conductive member 12 includes the input electrode 12A, a first extending portion 12B, a second extending portion 12C, a third extending portion 12D, and an output side electrode 12E.

The first extending portion 12B extends inward in the pivot axis direction from the input electrode 12A. The second extending portion 12C extends in the second perpendicular direction from an inner end portion of the first extending portion 12B in the pivot axis direction.

The third extending portion 12D extends toward the developing unit 2 from one end portion of the second extending portion 12C in the second perpendicular direction. That is, the third extending portion 12D extends in the counter-first direction from one end portion of the second extending portion 12C. The output side electrode 12E extends inward in the pivot axis direction from one end (developing unit side) of the third extending portion 12D.

As illustrated in FIG. 4(*c*), the blade-use first electrically conductive member 13 is connected to the layer thickness regulation blade 7 through the blade-use third electrically conductive member 33 and the blade-use second electrically conductive member 23. The blade-use first electrically conductive member 13 includes the input electrode 13A, a first extending portion 13B, a second extending portion 13C, a third extending portion 13D, and an output side electrode 13E.

The first extending portion 13B extends inward in the pivot axis direction from the input electrode 13A. The second extending portion 13C extends in the second perpendicular direction from inward end portion of the first extending portion 13B in the pivot axis direction.

The third extending portion 13D extends toward the developing unit 2 from one end portion of the second extending portion 13C in the second perpendicular direction. That is, the third extending portion 13D extends in the counter-first perpendicular direction. The output electrode 13E extends outward in the pivot axis direction from the end (developing unit side) of the third extending portion 13D. These output electrodes 11E, 12E, and 13E are spaced away from each other in the pivot axis direction.

As illustrated in FIG. 5, the connection frame 120 of the drum unit 1 has a side surface 121 in confrontation with the developing unit 2, and holes 122, 123, 124 are open at the side surface 121. Each of the output electrodes 11E, 12E, and 13E is exposed to the outside through the openings, respectively. Further, each end (at a drum unit side) of each of the electrically conductive members 31, 32, 33 in the form of the compression coil spring is in contact with and fixed to each of the output electrodes 11E, 12E, 13E, respectively. Incidentally, various fixing fashion is available. For example, each of the output electrodes 11E, 12E, 13E is formed with a hook portion, so that each end portion of each of the electrically conductive members 31, 32, 33 can be engaged with each hook portion. Alternatively, each end portion of each of the electrically conductive members 31, 32, 33 can be bonded to each of the output electrodes 11E, 12E, 13E by adhesive agent while these are in contact with each other. The adhesive agent is preferably made from electrically conductive material.

Figure 6:
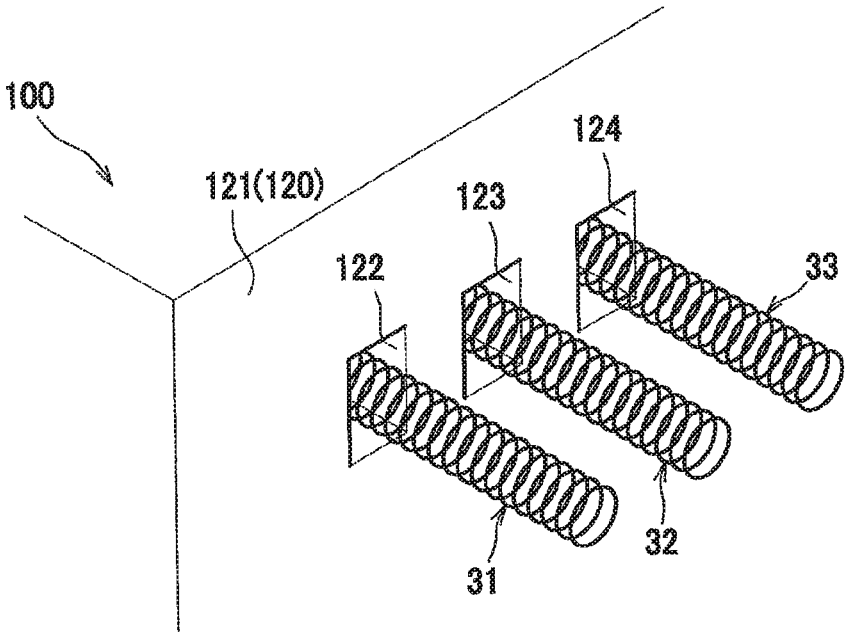
FIG. 6 is a perspective view illustrating an opening portion of a drum frame in the process cartridge according to the embodiment.

As illustrated in FIG. 6, each hole 122, 123, 124 has a rectangular cross-section whose long side extends in the second perpendicular direction. With this configuration, mechanical interference of each electrically conductive member 31, 32, 33 with the connection frame 120 due to bending of each electrically conductive member 31, 32, 33 in the second perpendicular direction in accordance with the pivot movement of the developing unit 2 can be restrained.

As illustrated in FIG. 4(*a*), the developing roller-use second electrically conductive member 21 includes an input electrode 21A, a first extending portion 21B, a second extending portion 21C, a third extending portion 21D, a fourth extending portion 21E, and an output electrode 21F.

The input electrode 21A is in contact with the contact portion 31B of the developing roller-use third electrically conductive member 31 for receiving electric power from the developing roller-use third electrically conductive member 31. The input electrode 21A has a U-shaped cross-section opening to the drum unit 1. The input electrode 21A has an inner surface A1 having an arcuate cross-section in conformance with the arcuate shape of the contact portion 31B of the developing roller-use third electrically conductive member 31. With this configuration, the input electrode 21A pivotally movably supports the developing roller-use third electrically conductive member 31.

Further, the inner surface A1 provides its central angle greater than 180 degrees. Therefore, the inner surface A1 can cover more than semicircular length of the contact portion 31B to hold the same, thereby restraining disengagement of the contact portion 31B from the input electrode 21A.

The first extending portion 21B extends outward in the pivot axis direction from the input electrode 21A. The second extending portion 21C extends in the counter-first perpendicular direction from an outer end portion of the first extending portion 21B in the pivot axis direction.

The third extending portion 21D extends in the counter-second perpendicular direction (downward in FIG. 4(*a*)), from an end portion of the second extending portion 21C in the first perpendicular direction. The fourth extending portion 21E extends obliquely toward the center of the developing roller 5 from an end of the third extending portion 21D in the counter-second perpendicular direction. The output electrode 21F is provided at an end portion of the fourth extending portion 21E and is in contact with a metallic rotation shaft (not illustrated) of the developing roller 5.

As illustrated in FIG. 4(*b*), the supply roller-use second electrically conductive member 22 includes an input electrode 22A, a first extending portion 22B, a second extending portion 22C, a third extending portion 22D, a fourth extending portion 22E, and an output electrode 22F. The input electrode 22A is in contact with the contact portion 32B of the supply roller-use third electrically conductive member 32 for receiving electric power from the supply roller-use third electrically conductive member 32. The input electrode 22A has a configuration the same as that of the input electrode 21A of the developing roller-use second electrically conductive member 21.

The first extending portion 22B extends in the second perpendicular direction from the input electrode 22A. The second extending portion 22C extends outward in the pivot axis direction from one end portion of the first extending portion 22B in the second perpendicular direction.

The third extending portion 22D extends in the counter-first perpendicular direction from an outer end portion of the second extending portion 22C in the pivot axis direction. The fourth extending portion 22E extends in the counter-second perpendicular direction from an end portion of the third extending portion 22D in the first perpendicular direction. The output electrode 22F is provided at an end portion of the fourth extending portion 22E and is in contact with a metallic rotation shaft (not illustrated) of the supply roller 6.

As illustrated in FIG. 4(*c*), the blade-use second electrically conductive member 23 includes an input electrode 23A, a first extending portion 23B, a second extending portion 23C, a third extending portion 23D, and a fourth extending portion 23E. The input electrode 23A is in contact with the contact portion 33B of the blade-use third electrically conductive member 33 for receiving electric power from the blade-use third electrically conductive member 33. The input electrode 23A has a configuration the same as that of the input electrode 21A of the developing roller-use second electrically conductive member 21.

The first extending portion 23B extends in the counter-second perpendicular direction from the input electrode 23A. The extending direction of the first extending portion 23B is opposite to that of the first extending portion 22B. The second extending portion 23C extends outward in the pivot axis direction from an end portion of the first extending portion 23B in the second perpendicular direction.

The third extending portion 23D extends in the counter-first perpendicular direction from an outer end portion of the second extending portion 23C in the pivot axis direction. The fourth extending portion 23E extends in the counter-second perpendicular direction from an end portion of the third extending portion 23D in the first perpendicular direction. The fourth extending portion 23E has an end portion in the second perpendicular direction functioning as the output electrode 23F in contact with the layer thickness regulation blade 7.

As illustrated in FIG. 7, the input electrodes 21A, 22A, 23A are spaced away from each other in the pivot axis direction. More specifically, as illustrated in FIG. 5, the input electrodes 21A, 22A, 23A are arrayed with a pitch the same as that of the output electrodes 11E, 12E, 13E of the drum unit 1.

As illustrated in FIG. 7, the cover 210 includes a first wall 211, a second wall 212, and a third wall 213. The second wall 212 extends in the counter-first perpendicular direction from an end of the first wall 211 in the second perpendicular direction. The third wall 213 extends in the counter-first perpendicular direction from an outer end of the first wall 211 in the pivot axis direction. As illustrated in FIG. 2, the cover 210 is positioned at one end portion of the developing frame 200 in the pivot axis direction, and is attached to the developing frame 200 so as to cover a corner portion of the developing frame 200.

Turning back to FIG. 7, the first wall 211 is formed with a first engagement hole 221, a second engagement hole 222, and a third engagement hole 223. These engagement holes 221, 222, 223 are arrayed in the pivot axis direction with a space between neighboring holes. More specifically, these engagement holes 221, 222, 223 are arrayed with a pitch the same as that of the input electrodes 21A, 22A, 23A.

Each of the engagement holes 221, 222, 223 is sized allowing each of the input electrodes 21A, 22A, 23A to be inserted thereinto, respectively. Each of the engagement holes 221, 222, 223 is aligned with each of the inner surfaces A1 of each of the input electrodes 21A, 22A, 23A, respectively in the pivot axis direction in a state where the cover 210 is attached to the developing frame 200. Thus, in the attached state of the cover 210 to the developing frame 200, each of the engagement holes 221, 222, 223 is engaged with each of the contact portions 31B, 32B, 33B restraining displacement of each of the contact portions 31B, 32B, 33B in the pivot axis direction.

Operation of the process cartridge PC will next be described. In accordance with the attachment of the process cartridge PC illustrated in FIG. 2 to the housing of the image forming apparatus, the four electrodes EP of the image forming apparatus are inserted into the through holes 111, 112, 113, 114, and are brought into contact with the electrically conductive members 11, 12, 13, 14 illustrated in FIG. 3. For controlling printing operation, each electrode EP of the image forming apparatus supplies electric power to each of the electrically conductive members 11-14.

Electric power supplied to the charge-roller use first electrically conductive member 14 is transmitted to the charge roller 4. Further, as illustrated in FIG. 4(*a*), electric power supplied to the developing roller-use first electrically conductive member 11 is transmitted to the developing roller 5 through the developing roller-use third electrically conductive member 31 and the developing roller-use second electrically conductive member 21.

As illustrated in FIG. 4(*b*), electric power supplied to the supply roller-use first electrically conductive member 12 is transmitted to the supply roller 6 through the supply roller-use third electrically conductive member 32 and the supply roller-use second electrically conductive member 22. As illustrated in FIG. 4(*c*), electric power supplied to the blade-use first electrically conductive member 13 is transmitted to the layer thickness regulation blade 7 through the blade-use third electrically conductive member 33 and the blade-use second electrically conductive member 23.

As illustrated in FIG. 1(*a*), in the case of print control, that is, in the case of developing operation at a predetermined developing unit 2, minute vibration in the pivotally moving direction may occur in the developing unit 2 due to minute surface irregularities of the photosensitive drum 3. In such a case, the third electrically conductive member 30 is resiliently deformed in accordance with the vibration, so that relative frictional motion between the contact portions 31B, 32B, 33B and the input electrodes 21A, 22A, 23A can be restrained. Consequently, frictional wearing of the contact portions 31B, 32B, 33B and the input electrodes 21A, 22A, 23A can be restrained.

Further, as illustrated in FIG. 1(*b*), in the case of the pivotal movement of the predetermined developing unit 2 for separating the developing roller 5 from the photosensitive drum 3, the third electrically conductive member 30 is resiliently deformed in accordance with the pivotal motion. Accordingly, relative frictional motion between the contact portions 31B, 32B, 33B and the input electrodes 21A, 22A, 23A can be restrained, and consequently, frictional wearing of the contact portions 31B, 32B, 33B and the input electrodes 21A, 22A, 23A can be restrained.

Further, additional advantages in the above-described embodiment will be described. In the embodiment, the input electrodes 11A, 12A, 13A and the electrically conductive members 31, 32, 33 are aggregated at one end portion of the connection frame 120 in the pivot axis direction. Therefore, a path length from each input electrode 11A, 12A, 13A to each electrically conductive member 31, 32, 33 can be reduced. That is, a size of the first electrically conductive members 10 can be reduced.

Further, the third electrically conductive member 30 functions as a first urging member for urging the developing unit 2 toward the photosensitive drum 3. Therefore, additional urging member for this purpose may not be required or may be simplified.

Further, each of the contact portions 31B, 32B, 33B has the arcuate cross-sectional shape. Therefore, sufficient contact between the contact portion and the second electrically conductive member 20 can be obtained in spite of deformation of the third electrically conductive member 30 due to the pivotal movement of the developing unit 2.

Further, the first electrically conductive member 10 is made from electrically conductive resin. Therefore, the drum frame 100 made from resin and the first electrically conductive member 10 can be easily produced by two color molding.

Further, the second electrically conductive member 20 is made from electrically conductive resin. Therefore, the developing frame 200 made from resin and the second electrically conductive member 20 can be easily produced by two color molding.

Next, various modified embodiments will be described with reference to FIGS. 8 through 13 wherein like parts and components are designated by the same reference numerals as those shown in FIGS. 1 through 7 for avoiding duplicating description.

Figure 8:
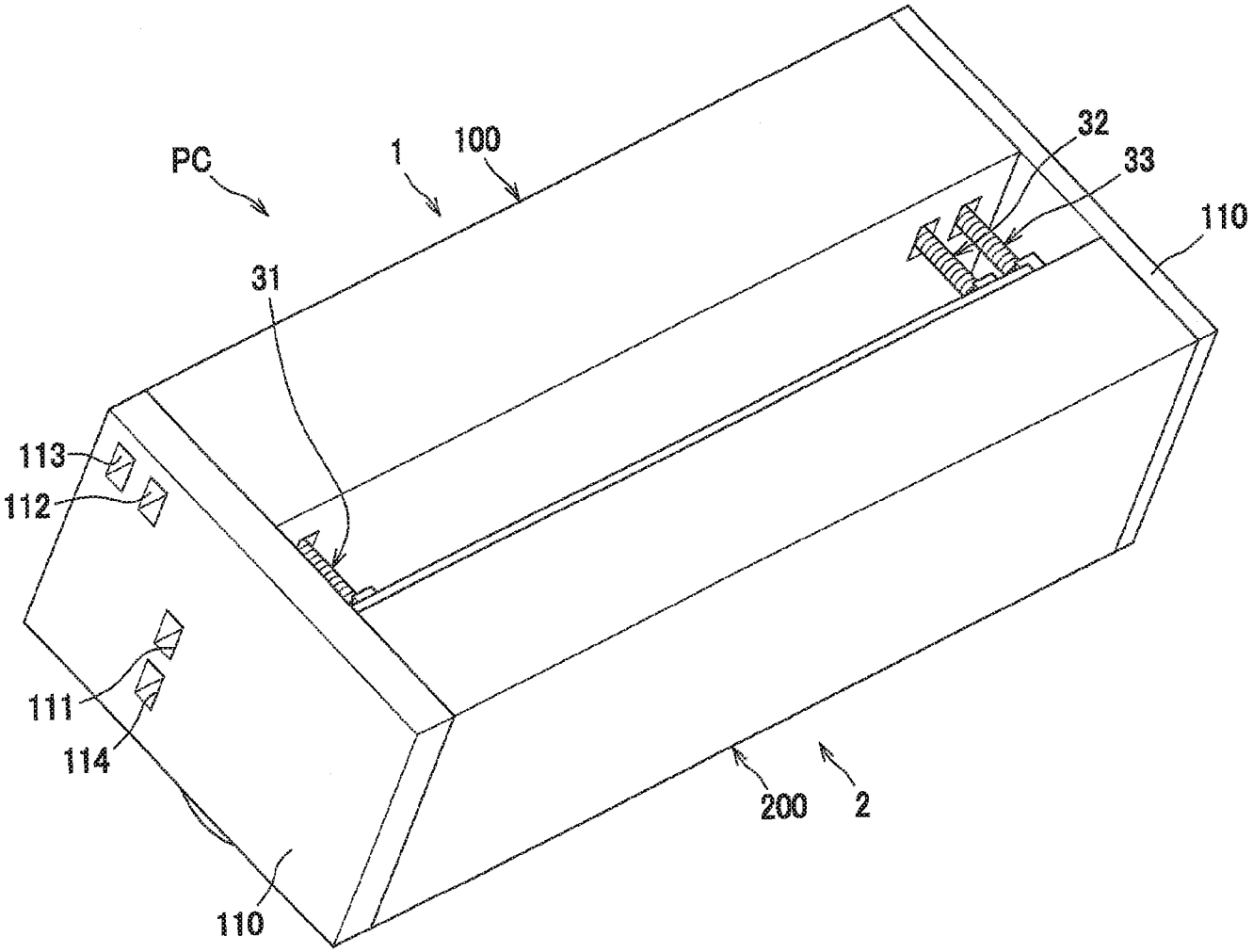
FIG. 8 is a perspective view of a process cartridge according to a first modification.

According to the above-described embodiment, the developing roller-use third electrically conductive member 31, the supply roller-use third electrically conductive member 32, and the blade-use third electrically conductive member 33 are positioned at one end portion of the process cartridge PC in the pivot axis direction. However, according to a first modification illustrated in FIGS. 8 through 10, the developing roller-use third electrically conductive member 31 is positioned at one end portion of the process cartridge PC in the pivot axis direction, and the supply roller-use third electrically conductive member 32 and the blade-use third electrically conductive member 33 are positioned at another end portion thereof as illustrated in FIG. 8. With this configuration, the developing unit 2 can be urged in a well-balanced manner by the electrically conductive members 31 and 32, 33 those being distributed to the one end portion and the other end portion of the process cartridge PC in the pivot axis direction.

Figure 9:
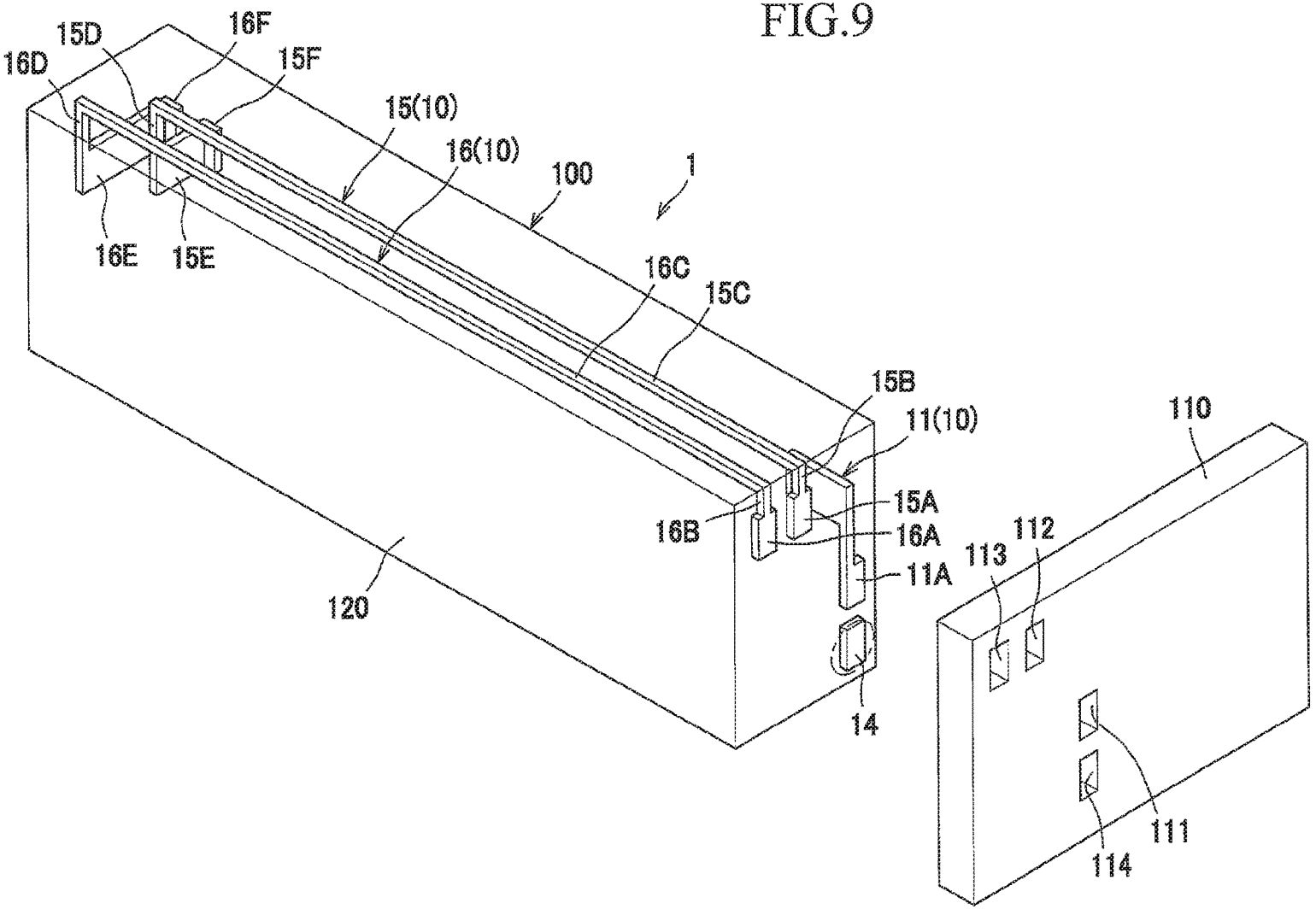
FIG. 9 is an exploded perspective view of a first electrically conductive member and a side frame in the process cartridge according to the first modification.

In the first modification, the first electrically conductive member 10 and the second electrically conductive member 20 have structures as illustrated in FIG. 9. More specifically, the first electrically conductive member 10 includes the above-described developing roller-use first electrically conductive member 11, a supply roller-use first electrically conductive member 15 corresponding to the supply roller-use first electrically conductive member 12, and a blade-use first electrically conductive member 16 corresponding to the blade-use first electrically conductive member 13. It is noted that the supply roller-use first electrically conductive member 15 and the blade-use first electrically conductive member 16 have different configurations of those of the above-described embodiment.

The supply roller use first electrically conductive member 15 includes an input electrode 15A in contact with the electrode EP of the image forming apparatus, a first extending portion 15B, a second extending portion 15C, a third extending portion 15D, a fourth extending portion 15E, and an output electrode 15F. The input electrode 15A is positioned at one side of the input electrode 11A in the first perpendicular direction (at a downstream side of the input electrode 11A in a direction from the developing roller 5 to the photosensitive drum 3, i.e., the first perpendicular direction), and is positioned at one end portion (upper end portion in FIG. 9) of the connection frame 120 in the second perpendicular direction. The input electrode 15A is exposed to an outside through the second through-hole 112.

The first extending portion 15B extends in the second perpendicular direction from an end of the input electrode 15A. The second extending portion 15C extends in the pivot axis direction to the other end portion of the connection frame 120 from an end of the first extending portion 15B.

The third extending portion 15D extends in the counter-second perpendicular direction from an end of the second extending portion 15C. The fourth extending portion 15E extends in the counter-first perpendicular direction from an end of the third extending portion 15D. The output electrode 15F extends inward in the pivot axis direction from an end of the fourth extending portion 15E. The output electrode 15F is in contact with the supply roller-use third electrically conductive member 32 (FIG. 8).

The blade-use first electrically conductive member 16 includes an input electrode 16A in contact with the electrode EP of the image forming apparatus, a first extending portion 16B, a second extending portion 16C, a third extending portion 16D, a fourth extending portion 16E, and an output electrode 16F. The input electrode 16A is positioned at a downstream side of the input electrode 15A of the supply roller use first electrically conductive member 15 in the first perpendicular direction, and is exposed to the outside through the third through-hole 113.

The first extending portion 16B extends in the second perpendicular direction from the input electrode 16A. The second extending portion 16C extends in the pivot axis direction to an end portion of the drum frame 100 from an end of the first extending portion 16B. More specifically, the second extending portion 16C extends further to the one end portion of the drum frame 100 than the second extending portion 15C to the one end portion thereof.

The third extending portion 16D extends in the counter-second perpendicular direction from an end of the second extending portion 16C. The fourth extending portion 16E extends in the counter-first perpendicular direction from an end of the third extending portion 16D. The output electrode 16F extends inward in the pivot axis direction from an end of the fourth extending portion 16E. The output electrode 16F is positioned outward of the output electrode 15F in the pivot axis direction. The output electrode 16F is in contact with the blade-use third electrically conductive member 33 (FIG. 8).

Figure 10:
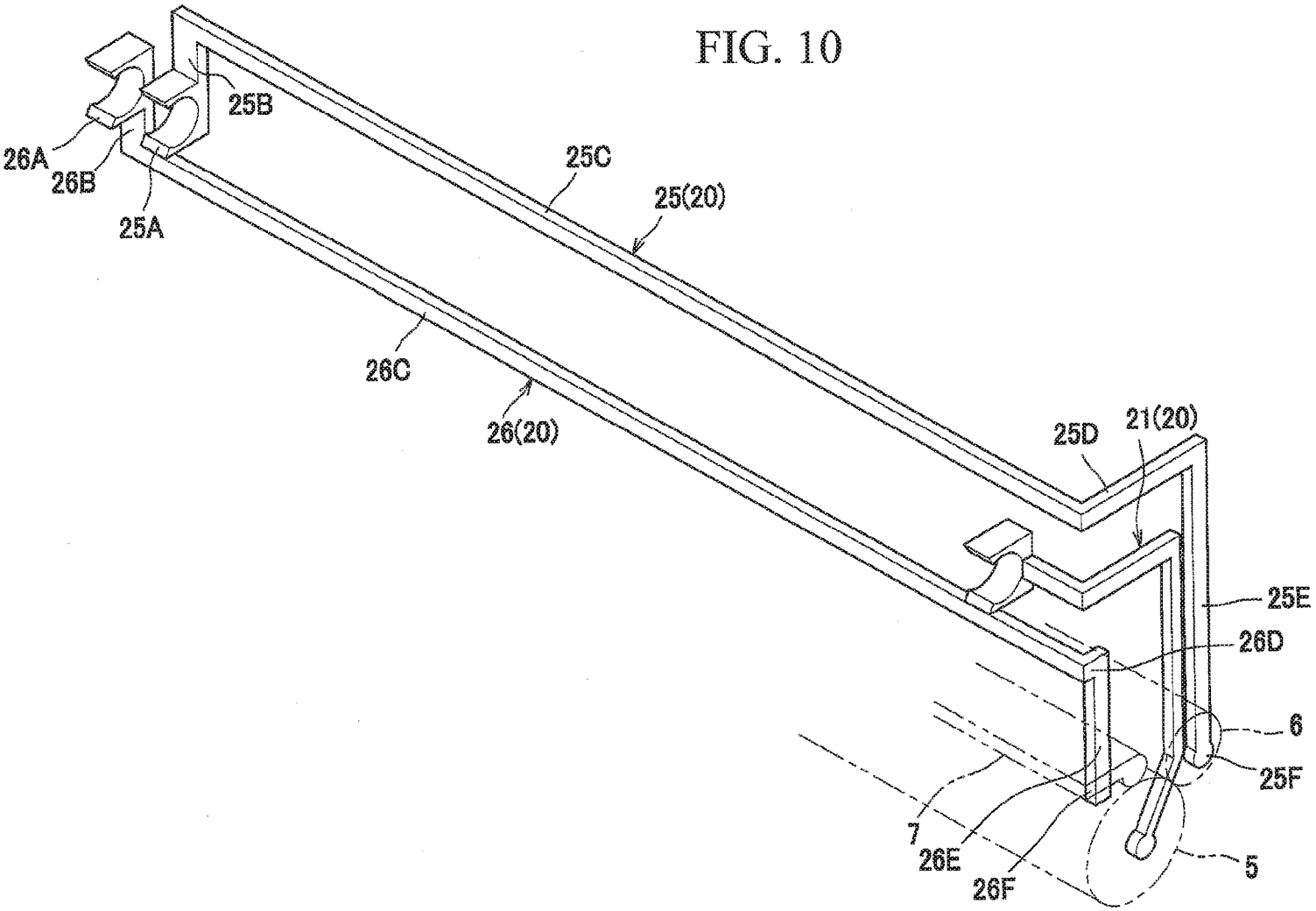
FIG. 10 is a perspective view of a second electrically conductive member in the process cartridge according to the first modification.
Figure 11:
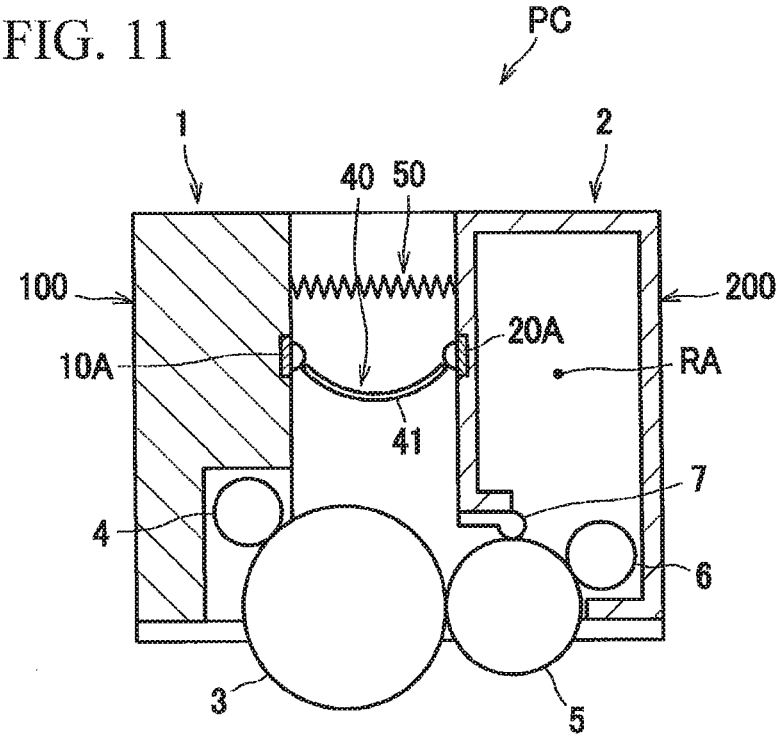
FIG. 11 is a cross-sectional view of a process cartridge according to a second modification.

As illustrated in FIG. 10, the second electrically conductive member 20 includes the developing roller-use second electrically conductive member 21 which is similar to that of the above-described embodiment, a supply roller-use second electrically conductive member 25 corresponding to the supply roller-use second electrically conductive member 22, and a blade-use second electrically conductive member 26 corresponding to the blade-use second electrically conductive member 23. It is noted that the supply roller-use second electrically conductive member 25 and the blade-use second electrically conductive member 26 have the different configurations of those of the above-described embodiment.

The supply roller-use second electrically conductive member 25 includes an input electrode 25A corresponding to the input electrode 22A of the above-described embodiment, a first extending portion 25B, a second extending portion 25C, a third extending portion 25D, a fourth extending portion 25E, and an output electrode 25F. The input electrode 25A is in contact with the supply roller-use third electrically conductive member 32 (FIG. 8).

The first extending portion 25B extends in the second perpendicular direction from the input electrode 25A. The second extending portion 25C extends in the pivot axis direction to the one end portion of the drum frame 100 from an end of the first extending portion 25B.

The third extending portion 25D extends in the counter-first perpendicular direction from an end of the second extending portion 25C. The fourth extending portion 25E extends in the counter-second perpendicular direction from an end of the third extending portion 25D. The output electrode 25F is provided at an end of the fourth extending portion 25E and in contact with the supply roller 6.

The blade-use second electrically conductive member 26 includes an input electrode 25A corresponding to the input electrode 23A of the above-described embodiment, a first extending portion 26B, a second extending portion 26C, a third extending portion 26D, and a fourth extending portion 26E. The input electrode 25A is positioned outward of the input electrode 25A of the supply roller-use second electrically conductive member 25 in the pivot axis direction, and is in contact with the blade-use third electrically conductive member 33 (FIG. 8).

The first extending portion 26B extends in the counter-second perpendicular direction from the input electrode 25A. The second extending portion 26C extends in the pivot axis direction to the one end portion of the drum frame 100 from an end of the first extending portion 26B.

The third extending portion 26D extends in the counter-first perpendicular direction from an end of the second extending portion 26C. The fourth extending portion 26E extends in the counter-second perpendicular direction from an end of the third extending portion 26D. The fourth extending portion 26E has a free end portion functioning as the output electrode 26F in contact with the layer thickness regulation blade 7.

The first modification described above provides function and effect similar to those of the above-described embodiment.

In the above-described embodiment, the compression coil spring is used as the third electrically conductive member 30. However, according to a second modification illustrated in FIG. 11, a third electrically conductive member 40 can be interposed between the drum unit 1 and the developing unit 2 in a slackened manner. More specifically, the third electrically conductive member 40 includes an electrically conductive metal wire (not illustrated) and a cover layer 41 covering the metal wire.

The third electrically conductive member 40 has one end portion connected to the first electrically conductive member 10A by soldering, and another end portion connected to the second electrically conductive member 20A by soldering.

A process cartridge PC according to a second modification further includes a second urging member 50 adapted to urge the developing unit 2 toward the photosensitive drum 3. The second urging member 50 is not electrically connected to the first electrically conductive member 10A and second electrically conductive member 20A. That is, the second urging member 50 only provides function for urging the developing unit 2.

In the second modification, the slacking of the third electrically conductive member 40 can absorb the pivotal movement of the developing unit 2, and therefore, the second modification can provide function and effect similar to those of the above-described embodiment.

Figure 12:
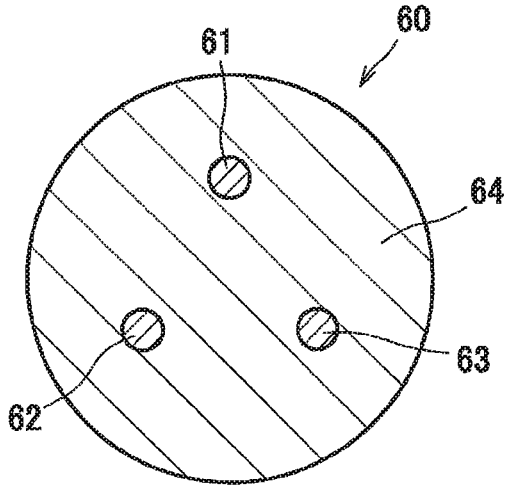
FIG. 12 is a cross-sectional view of a third electrically conductive member in a process cartridge according to a third modification.

FIG. 12 illustrates a third modification for the third electrically conductive member 60. The third electrically conductive member 60 includes a developing roller-use third electrically conductive member 61, a supply roller-use third electrically conductive member 62, and a blade-use third electrically conductive member 63 those being metal wires, and a trunking member 64 made from electrically insulation material and coated over the electrically conductive members 61, 62, 63 bundled together. These electrically conductive members 61, 62, 63 are positioned away from each other in the insulation layer 64. This structure can reduce the number of parts since three conductive members 61, 62, 63 are bundled together to form a single cable.

Incidentally, each of the conductive members 61, 62, 63 can provide resiliently deformable performance. In this case, the single cable containing the conductive members 61, 62, 63 can be formed into a coil like shape. This structure can render the third electrically conductive member 60 as being the first urging member adapted to urge the developing unit 2.

Figure 13:
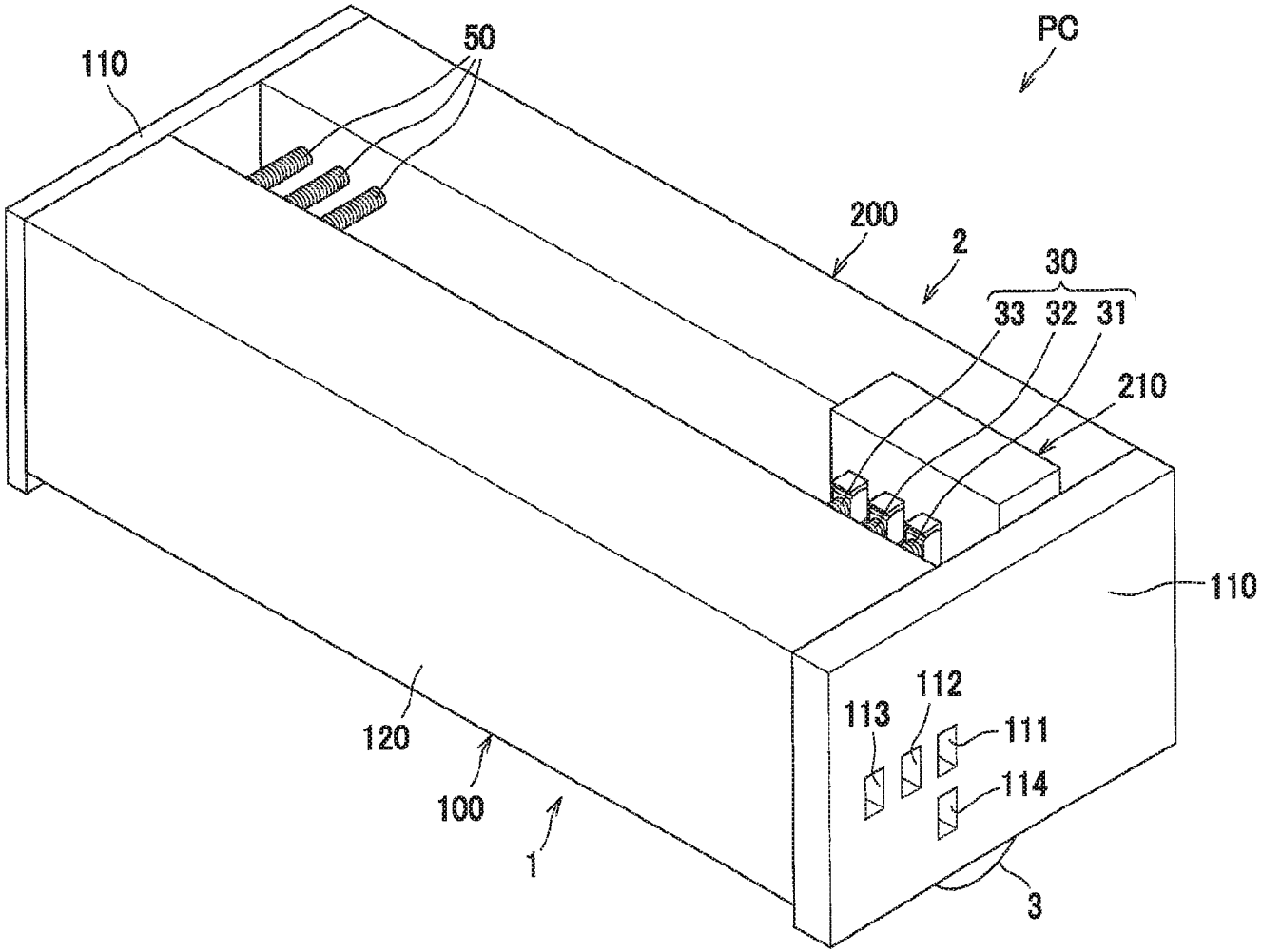
FIG. 13 is a perspective view of a process cartridge according to a fourth modification.

FIG. 13 illustrates a fourth modification in which a set of second urging members 50 is provided at another end portion of the process cartridge PC in the pivot axis direction in addition to the third electrically conductive member 30 provided at one end portion thereof. According to the fourth modification, the numbers of the urging members 50 is the same as that of the third electrically conductive member 30 (the electrically conductive members 31, 32, 33) which are positioned at the one end in the pivot axis direction of the process cartridge PC. Further, the second urging members 50 can be the compression coil springs the same as the first urging member. According to the fourth modification, the developing unit 2 can be urged in a well-balanced manner by the urging members provided at one end portion and the other end portion of the process cartridge PC in the pivot axis direction.

In the above described embodiments, the developing unit 2 is pivotally movable relative to the drum unit 1. However, the present invention is not limited to the above-described embodiments. For example, a developing unit can be linearly movable toward and away from a drum unit.

Further, in the above-described embodiment, the compression coil springs are used as the third first and second urging members. However, a tensile coil spring, a leaf spring, and a torsion spring are available as the urging members. While the description has been made in detail with reference to specific embodiment(s) thereof, it would be apparent to those skilled in the art that various changes and modifications may be made therein without departing from the spirit and scope of the above described embodiment.

What is claimed is:

1. A process cartridge comprising:

a drum unit comprising a photosensitive drum;

a developing unit comprising a developing roller and movable relative to the drum unit;

a first electrically conductive member provided at the drum unit and configured to contact a terminal of an image forming apparatus;

a second electrically conductive member provided at the developing unit; and a third electrically conductive member electrically connected to the first electrically conductive member and to the second electrically conductive member, the third electrically conductive member being deformable in accordance with the movement of the developing unit.

2. The process cartridge according to claim 1, wherein:

a combination of the drum unit and the developing unit provides one end portion in an axial direction of the photosensitive drum; and the first electrically conductive member has an input electrode configured to be in contact with the terminal, the input electrode and the third electrically conductive member being positioned at one end portion.

3. The process cartridge according to claim 1, wherein the third electrically conductive member functions as a first urging member urging the developing unit toward the photosensitive drum.

4. The process cartridge according to claim 3, wherein:

a combination of the drum unit and the developing unit provides one end portion and another end portion in an axial direction of the photosensitive drum;

the first urging member is provided at the one end portion; and the process cartridge further comprises a second urging member provided at the another end portion.

5. The process cartridge according to claim 3, wherein a combination of the drum unit and the developing unit provides one end portion and another end portion in an axial direction of the photosensitive drum, the first urging member being provided at the one end portion and the another end portion.

6. The process cartridge according to claim 3, wherein the first urging member comprises a compression coil spring.

7. The process cartridge according to claim 3, wherein:

the developing unit is supported to the drum unit and is pivotally movable about a pivot axis; and the first urging member has a contact portion in contact with the second electrically conductive member; the contact portion having an arcuate cross-section taken along a plane perpendicular to the pivot axis.

8. The process cartridge according to claim 1, wherein:

the second electrically conductive member comprises a developing roller-use second electrically conductive member in electrical contact with the developing roller; and the third electrically conductive member comprises a developing roller-use third electrically conductive member configured to be in electrical contact with the developing roller-use second electrically conductive member; and the first electrically conductive member comprises a developing roller-use first electrically conductive member configured to be in electrical contact with the developing roller-use third electrically conductive member.

9. The process cartridge according to claim 8, wherein the developing unit further comprises a layer thickness regulation blade configured to regulate a thickness of a toner layer formed on the developing roller;

the second electrically conductive member comprises a blade-use second electrically conductive member in electrical contact with the layer thickness regulation blade;

the third electrically conductive member comprises a blade-use third electrically conductive member configured to be in electrical contact with the blade-use second electrically conductive member; and the first electrically conductive member comprises a blade-use first electrically conductive member configured to be in electrical contact with the blade-use third electrically conductive member.

10. The process cartridge according to claim 9, wherein:

the developing unit further comprises a supply roller configured to supply toner to the developing roller;

the second electrically conductive member comprises a supply roller-use second electrically conductive member in electrical contact with the supply roller;

the third electrically conductive member comprises a supply roller-use third electrically conductive member configured to be in electrical contact with the supply roller-use second electrically conductive member; and the first electrically conductive member comprises a supply roller-use first electrically conductive member configured to be in electrical contact with the supply roller-use third electrically conductive member.

11. The process cartridge according to claim 10, wherein the third electrically conductive member comprises:

the developing roller-use third electrically conductive member in a form of a first wire;

the blade-use third electrically conductive member in a form of a second wire;

the supply roller-use third electrically conductive member in a form of a third wire, the first wire, the second wire and the third wire being bundled together to form a wire bundle; and a trunking layer formed over the wire bundle, so that the third electrical conductive member is in a form of a cable.

12. The process cartridge according to claim 1, wherein:

the drum unit further comprises a drum frame made from resin and supporting the photosensitive drum; and the first electrically conductive member is made from electrically conductive resin.

13. The process cartridge according to claim 1, wherein the developing unit further comprises a developing frame made from resin; wherein the second electrically conductive member is made from electrically conductive resin.

14. The process cartridge according to claim 1, wherein the third electrically conductive member comprises a conductive wire connected between the drum unit and the developing unit in a slackened fashion.

* * * * *